US011426323B2

(12) United States Patent
Thies

(10) Patent No.: US 11,426,323 B2
(45) Date of Patent: Aug. 30, 2022

(54) MULTI-FUNCTIONAL FOOT CRUTCH

(71) Applicant: Joint Project Limited, Warwick (GB)

(72) Inventor: Gillian Thies, Warwick (GB)

(73) Assignee: Joint Project Limited, Warwick (GB)

( * ) Notice: Subject to any disclaimer, the term of this patent is extended or adjusted under 35 U.S.C. 154(b) by 0 days.

(21) Appl. No.: 16/731,700

(22) Filed: Dec. 31, 2019

(65) Prior Publication Data

US 2020/0206066 A1 Jul. 2, 2020

(30) Foreign Application Priority Data

Dec. 31, 2018 (GB) ..... 1821319

(51) Int. Cl.
*A61H 3/02* (2006.01)
*A45B 9/04* (2006.01)
*A61H 3/00* (2006.01)

(52) U.S. Cl.
CPC ..... *A61H 3/0244* (2013.01); *A45B 9/04* (2013.01); *A61H 3/02* (2013.01); *A61H 2003/005* (2013.01); *A61H 2003/0205* (2013.01); *A61H 2003/0272* (2013.01)

(58) Field of Classification Search
CPC .... A45B 1/00; A45B 5/00; A45B 9/04; A61H 2003/005; A61H 3/0244; A61H 2003/0272; A61H 3/0288
See application file for complete search history.

(56) References Cited

U.S. PATENT DOCUMENTS 697,146 A * 4/1902 Howard ..... A45B 5/00 248/155
1,089,295 A * 3/1914 Vallier ..... A45B 5/00 248/155.1
2,127,976 A * 8/1938 K-Howat ..... A45B 5/00 135/66
2,793,680 A * 5/1957 Eben ..... A45B 5/00 248/155.1
3,310,340 A * 3/1967 Brewer ..... A45B 5/00 297/16.1
7,219,679 B2 * 5/2007 Hsu ..... B26B 13/24 135/65
7,344,320 B2 * 3/2008 Barker ..... F16M 11/14 135/66
7,905,667 B2 * 3/2011 Barker ..... F16M 11/242 396/419

(Continued)

*Primary Examiner* — David R Dunn
*Assistant Examiner* — Danielle Jackson
(74) *Attorney, Agent, or Firm* — Morgan, Lewis & Bockius LLP

(57) ABSTRACT

A crutch (102) for supporting a leg of a user is described. The crutch comprises a handle (112), a base portion (116) having plurality of legs (114) that define a footprint when contacting the ground, and a main rod (123) connecting the handle and the base portion. The base portion (116) is moveable to alter the length of the crutch (102) from a first configuration to a second configuration, and wherein in the first configuration the handle (112) is positioned at a first distance from the base portion (116) for gripping by an ambulatory user and in the second configuration the handle (112) is positioned at a second, shorter, distance from the base portion (116) for resting a foot of a sitting user; and wherein the base portion (116) provides a smaller footprint in the first configuration than in the second configuration.

8 Claims, 6 Drawing Sheets

(56) References Cited

U.S. PATENT DOCUMENTS

| | | | | |
|---|---|---|---|---|
| 9,179,746 | B2 * | 11/2015 | Gullo | A45B 5/00 |
| 10,149,522 | B1 * | 12/2018 | Persley | A47F 13/06 |
| 2017/0196322 | A1 * | 7/2017 | Denmark | A61H 3/0244 |

* cited by examiner

MULTI-FUNCTIONAL FOOT CRUTCH

CROSS REFERENCE TO RELATED APPLICATIONS

This application claims the benefit of GB Patent Application No. 1821319.9 filed Dec. 31, 2018 entitled "Multi-Functional Foot Crutch", which is incorporated by reference herein in its entirety.

FIELD OF INVENTION

The present invention relates to a multi-functional foot crutch that can be adapted for use as a foot rest.

BACKGROUND OF THE INVENTION

Crutches are often used by people to allow them to regain loss of mobility as a result of an injury or a disability. Where this injury is a broken/fractured ankle or foot, for an effectively recovery it is essential that no load/weight is applied to the leg at all times during the recovery process.

Crutches generally function by removing the weight of the patient on the injured leg when the subject is ambulatory. Typically, a pair of crutches are used to achieve this, which also assist in achieving balance and stability while the patient is on the move.

However, when the subject needs to sit down, it is often desirable to keep the leg in an elevated position such that no load is applied to the injured limb. This may be achieved, for example, using furniture as such a chair or table to rest the injured leg while sitting. However, on many occasions this simply may not be practical, and even when a suitable foot rest is available the height may not be correctly adjusted. This can lead to the patients being required to carry additional separate foot rests. Therefore, this is extremely inconvenient considering the fact that the subject is already handicapped by the injury.

The present invention aims to ameliorate these problems by providing a multi-functional foot crutch.

SUMMARY OF THE INVENTION

According to a first aspect of the present invention, there is provided a crutch for supporting a leg of a user, said crutch comprising: a handle; a base portion having a plurality of legs that define a footprint when contacting the ground; and a main rod connecting the handle and the base portion; wherein the base portion is moveable to alter the length of the crutch from a first configuration to a second configuration, and wherein in the first configuration the handle is positioned at a first distance from the base portion for gripping by an ambulatory user and in the second configuration the handle is positioned at a second, shorter, distance from the base portion for resting a foot of a sitting user; and wherein the base portion provides a smaller footprint in the first configuration than in the second configuration.

The present invention can extend the functionality of a traditional crutch that is solely designed as a walking aid to also provide foot rest for an injured leg when the user is sitting down. By providing an increased footprint in the second configuration, the stability of the foot rest is increased relative to the crutch in the ambulatory position or first configuration. This functionality allows the user to benefit from the smaller footprint in the ambulatory position, which makes the crutch easier to use, whilst having the stability required in the second configuration.

By changing the footprint of the crutch in the two configurations, the crutch is more versatile and better suited to both uses than either a traditional crutch (which would be difficult to balance a foot on in a lower seated position) or a tripod crutch (which is slower to use for an ambulatory user).

In one embodiment, the base portion may be rotatable relative to the main rod to alter the length of the crutch from the first configuration to the second configuration. In an alternative configuration the base portion may be translatable along the main rod to alter the length of the crutch from the first configuration to the second configuration.

Relative rotation of the base portion and the main rod can allow the crutch to be deployed in the required configuration easily. As an alternative, translation of the base portion along the main rod may allow a user with reduced manual dexterity to alter the crutch between the two configurations.

The base portion may comprise at least three legs to form a stable tripod when deployed. It can be appreciated that four legs or more may be used. It can be appreciated that although defined as legs, this may be considered to be separate points of contact between the crutch and the ground. So, a single rod extending from the base portion that has additional separate points of contact extending therefrom may be used. The area between the legs may be considered to define the footprint of the base portion.

As noted above, a stable footprint for the crutch is particularly advantageous in the second configuration, allowing a user to use the crutch hands-free. The crutch may be set-up adjacent to the seat before the user seats and rests their leg on the handle of the crutch.

In the first configuration the main rod and the legs may be aligned along a common longitudinal axis. This allows the crutch to have a smaller footprint, which aids use of the crutch in the first configuration, which can make it easier to use by an ambulatory user in the first configuration.

In the second configuration the legs may be splayed outward away from the longitudinal axis of the main rod, to increase the footprint of the base portion.

In some embodiments, the base portion may comprise a central leg. In such embodiments, a bottom of the central leg may be encapsulated in rubber to form a rubber base. The rubber base can act to provide friction between the base and the ground to hold the crutch upright.

The base portion may further comprise a pedal for allowing the user to depress or to lift the pedal to transform the crutch between the first and the second configuration. The pedal may be provided as a plinth connected to the central leg such that movement of the plinth actuates movement of the central leg into or out of a base rod. The plinth or pedal may further comprise a locking means, such as a spring based pressure lock, similar to those used on retractable pens or the like, whereby locking surfaces on an internal surface of the central leg are configured to interact with like protrusions on an external surface of the base rod to retrain motion of the central leg as it is retracted and extended in an outward relative to the base rod. It can be appreciated that the surfaces and protrusions may be inverted. The plinth or pedal may also act to release an engagement between the legs and the base portion, whereby the legs are locked against the hub portion in the first configuration, before being released by moving the pedal, which allows the legs to move and splay outward.

In the first configuration, the longitudinal axis of the rods or legs may be substantially in the same direction as the longitudinal axis of the main rod and the central leg. As noted above, the legs may be locked in this position by engagement of a locking surface on the leg or the hub and a locking receiving surface on the opposing surface.

In embodiments, the central leg may be located substantially outside a base rod when the crutch is the first configuration. In the second configuration the central leg may be substantially inside the base rod. This mechanism can allow the height of the handle to be adjusted by an amount equal to the length of the base rod.

The tips of the legs may comprise rollers for smooth splaying of the legs. When the crutch in maneuvered into the second configuration from the first configuration, the rollers can make contact with the ground. This can allow the legs to smoothly transition into the splayed configuration. The rollers may also allow a smooth transition from the splayed position to the first configuration where the legs are aligned along a common longitudinal axis position, when the crutch is maneuvered from the second configuration back into the first configuration.

In other embodiments, the legs may be resiliently biased away from the longitudinal axis. It can be appreciated that resiliently biasing the legs makes changing configuration from the first configuration to the second configuration easier. The resilient biasing may be a resilient spring, or the like.

In some embodiments, the base portion may comprise a hub portion and a locking section that cooperate to lock the legs along the longitudinal axis in the first configuration. The hub portion and the locking section may further cooperate to lock the splayed outward legs in the second configuration. The pedal or plinth may act to release engagement of the locking section and the hub portion.

The locking section may be rotatably engaged with the hub portion to releasably lock the legs in the first configuration. In such examples, the hub portion may comprise at least three semi-circular openings aligned with the legs in the second configuration to define an end stop for the legs to limit movement of the legs away from the main rod. This ensures that the resiliently biased legs only extend to a predefined distance in the second configuration.

The locking section may comprise at least three recesses, each recess defining a movement path for a leg. The locking section may be further operable to fix the legs in the first configuration by blocking splaying of the legs against the locking section in the first configuration.

The movement path of each recess may define an orbit about a centre of the locking section. Accordingly, rotation of the locking section relative to the hub portion may allow movement of the legs along the movement path. The legs may be blocked from splaying by the locking section when fixed in the first configuration; and furthermore the legs may be constrained in the second configuration when the recesses align with an end of the movement path.

In embodiments, the legs may be moveable to between 10 to 90 degrees away from the or a longitudinal axis of the main rod in the second configuration.

In some examples, the legs may be operable to move between the first configuration and the second configuration by rotation of the legs relative to the main rod.

The crutch may additionally comprise a supporting means for an arm, such as a cuff. The handle, cuff and the base portion may be securely attached to the main rod via fastening means such as glue or rivets.

Arranging the crutch into the second position or configuration can enable splaying of the base rods such that the crutch is able remain upright without the user needing to hold it. In this configuration, the height of the handle is lowered. Additionally, the length of the main rod may be telescopically adjustable. The combination of the telescopic height adjustment of the main rod and the adjustable base may allow the handle to be used as a foot rest, whilst the user is sitting down.

It can be appreciated that elements described in relation to one embodiment or example may be applied to other embodiments or examples.

These and other aspects of the invention will be apparent from, and elucidated with reference to, the embodiments described hereinafter.

BRIEF DESCRIPTION OF THE DRAWINGS

Embodiment of the invention shall now be described in detail by way of example and with reference to the accompanying drawings in which.

Figure 1:
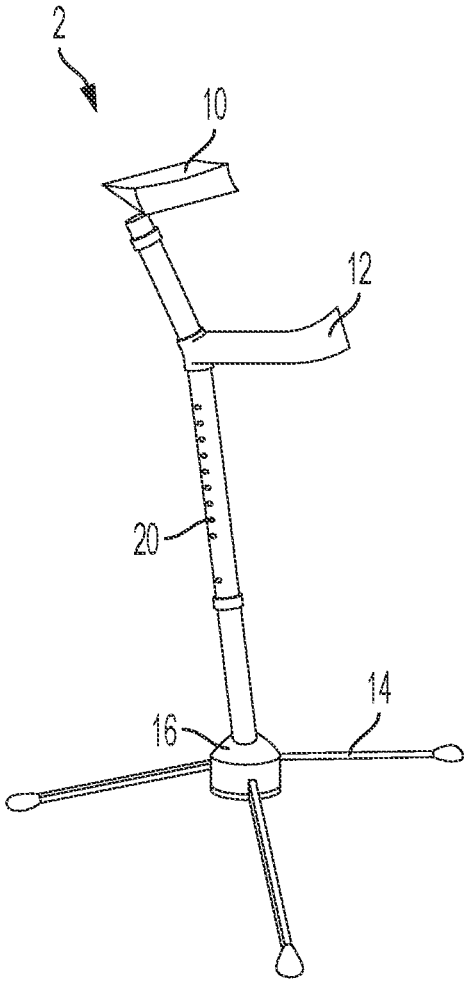
FIG. 1 illustrates a multi-configuration crutch according to an embodiment of the present invention.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments.

DETAILED DESCRIPTION OF EMBODIMENTS

In an exemplary embodiment of the present invention there is provided a multi-configuration foot crutch 2. FIG. 1 show the complete view of the crutch 2. In particular, the crutch 2 comprises a main rod 20 to which a cuff portion 10, a handle 12 and an adjustable base portion 16 are attached.

The main rod 20 typically is made of hollow aluminium and is a circular tube. A series of alignment holes are provided into which the cuff portion 10 and the base portion 16 are attached. The attachment may be by press rivets or studs that are received by the alignment holes to allow for adjustment of the length of the cuff portion 10 and the base portion 16 relative to the main rod 20. This allows the length of the crutch 2 to be telescopically adjusted to the length required for the user.

The handle 12 is typically moulded from a single piece of plastic that is rigidly attached to the main rod 10 by glue, rivets or the like. The handle 12 is typically longer than a standard crutch handle to allow for a stable base when the handle is used as a foot rest.

The base portion 16 typically comprises a circular locking portion and legs 14. Typically three legs 14 are provided, although more or less may be used. The area between the legs 14 define the footprint of the crutch. The base portion 16 is shown in greater detail in FIGS. 2 and 3.

The cuff 10 functions as a support for an arm, however, it may be appreciated that instead a crutch pad or any other supporting means for the arm can also be used. The cuff 10 typically comprises a hooped plastic brace through which an arm of the user may be placed when the crutch is in a first configuration.

The crutch 2 shown in FIG. 1 is in a second configuration. The legs 14 are splayed outwards, with a large footprint to provide a stable base to the crutch 2. The height of the handle 12 is provided at a height suited for a leg-rest of a seated user.

Figure 2:
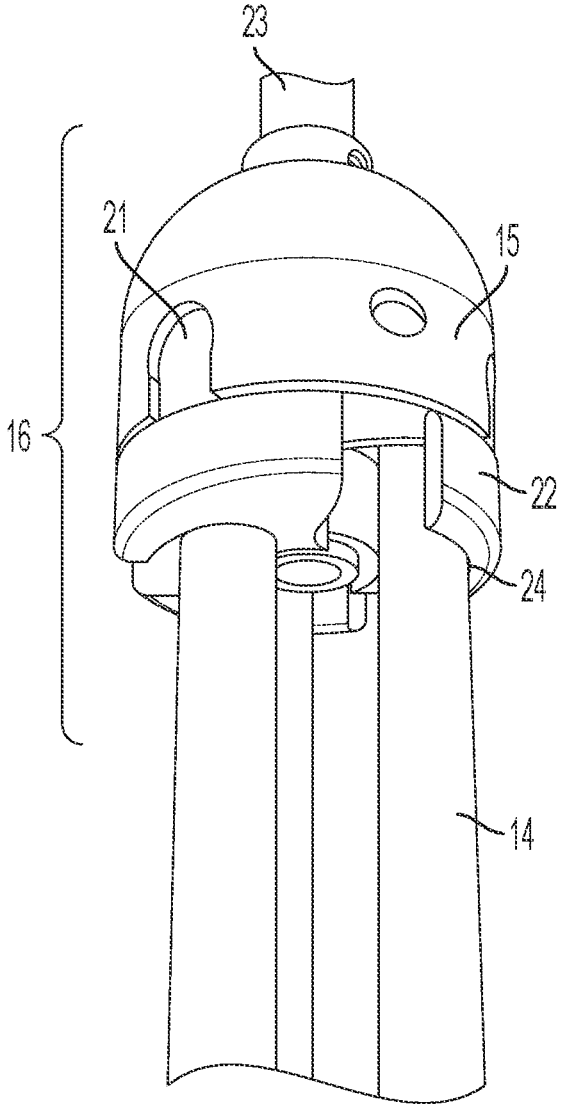
FIG. 2 illustrates base portion shown in FIG. 1 attached to main rod of the crutch where the crutch is in the first configuration.
Figure 3:
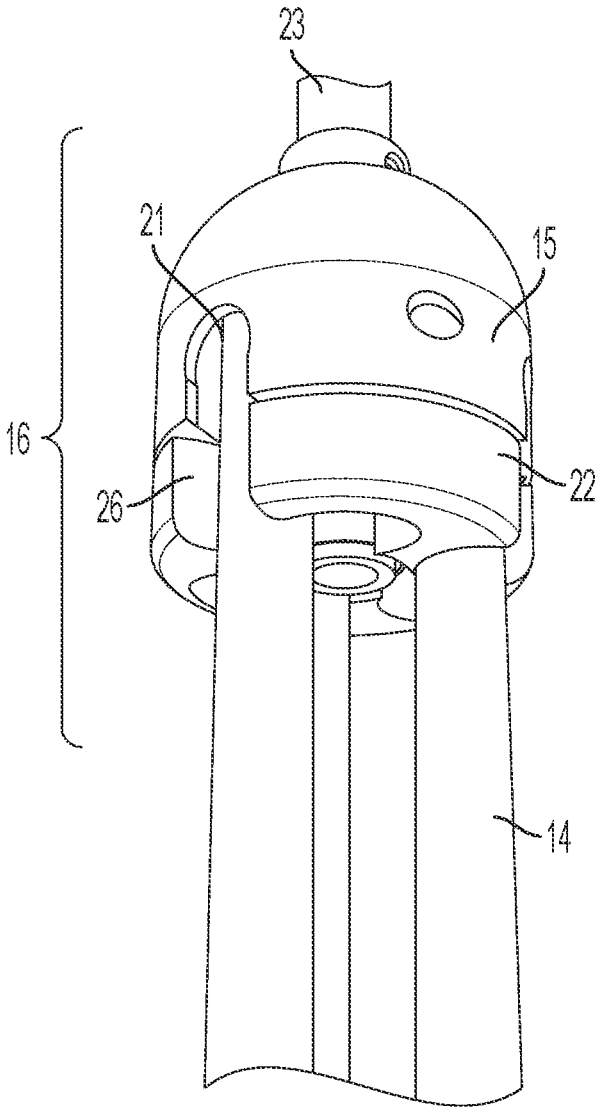
FIG. 3 illustrates the base portion attached to main rod of the crutch when the crutch is in the second configuration.

FIGS. 2 and 3 depict a close up view of the adjustable base portion 16. The base portion 16 comprises a hub portion 15 with three semi-circular openings 21. A base rod 23 is coupled to the hub portion 15 and allows the base rod 23 to be joined to the main rod 20 as noted above.

The legs 14 are hingedly attached to the hub portion 15 and resiliently biased away from the axis of the main rod 20. The three legs 14 are attached to the hub portion 15 via hinge joints. It may be appreciated that that any number of rods may be connected to the base portion 16. The base of the legs 14 may be encapsulated with rubber tips to increase friction between the base of the legs 14 and the ground.

Also attached to the base portion 16 is a circular rotatable locking portion or locking section 22 with a central axis. The locking portion 22 is rotatably engaged to the hub portion 15 via an axle rod or the like. The locking portion 22 comprises three recesses 24 that provide a travelling path for each leg 14. The travelling paths define orbits about the central axis of the base portion 16. The recesses 24 are shaped in a concave manner, such that a space is formed between any two adjacent arms.

The hinge mechanism and the locking portion 22 allow the legs (and therefore the crutch) to be configured into a first position or configuration. In this position, the longitudinal axis of the legs 14 is substantially in the same direction as the longitudinal axis of the main rod 20. This is illustrated in FIGS. 2 and 3.

When the locking portion 22 is rotated in a first direction, the rods are fixed into the first configuration as the legs 14 are completely accommodated within the recesses 24. This first configuration is illustrated in FIG. 2. The legs 14 in this configuration provide a smaller footprint than the second configuration. Furthermore, this configuration is useful when the user needs to be on the move, because the crutch now functions as a common walking aid.

Alternatively, when the locking portion 22 is rotated in a second direction that is opposite the first direction the legs 14 travel along the recesses 24 until the legs have travelled along the length of the recess 24. Additionally, the locking portion 22 also aligns with semi-circular openings 21 in the hub portion 15. The resilient biasing of the legs 14 allow the legs to splay outward away from the centre axis of the base portion 16. The openings 21 act as an end stop to limit the movement of the legs 14, as shown in FIG. 3. In particular, the legs 14, constrained by the travelling path, travel along the travelling path until the openings 21 and 26 align.

This allows the rods 14 to be configured into a second position or configuration, where the longitudinal axis of the legs 14 is substantially in a different (splayed) direction to the longitudinal axis of the main rod 20. This configuration is illustrated in FIG. 1. To attain the second configuration, the legs 14 may be rotated about their respective hinge joints at an angle anywhere between 10 to 90 degrees relative to the first configuration. The semi-circular openings 21 on the hub portion 15 enable the legs 14 to be configured into the second configuration.

The above arrangement splays the rods in a manner that keeps the crutch 2 in an upright position without the need for the user to hold the crutch 2, and lowers the height of the handle 12 relative to the ground. Coupled with the telescopic adjustment capability of the main rod 20 (common to many crutches available today), this configuration allows the handle 12 to function as a foot rest for a seated user.

It may be appreciated that the locking section 22 may comprise any number of arms or recesses 24 to match the number of the legs 14 used for the base portion 16, and that the locking section 22 may not be a rotatable lock but instead comprise any mechanism capable of locking the rods in the first configuration.

In another embodiment, the legs may be adjusted between the first configuration and the second configuration by moving the base portion 16 relative to the base rod 23. It can be appreciated that the base portion 16 acts as a cuff that constrains the legs 14 in the first configuration by cuffing the legs at around the mid point of the legs. In the second configuration the cuff cuffs the legs at around the top point of the legs.

In another embodiment, the base portion is rotated such that the crutch and the legs are moved from the first configuration to the second configuration by rotation of the handle 12 relative to the main rod 20.

In an embodiment 100, an alternative crutch is shown. FIGS. 4*a* to 4*d*, and FIG. 5, illustrate this embodiment. In this embodiment, a crutch 102 is shown. The crutch 102 comprises many of the elements and features described above, including a cuff portion 110, handle 112, main rod 120 and base rod 123. The cuff 110 may be adjusted in height by altering the relative positions between a cuff rod 118 and an angled handle rod 117 that interact via spring buttons that push through holes 119.

Figure 4A:
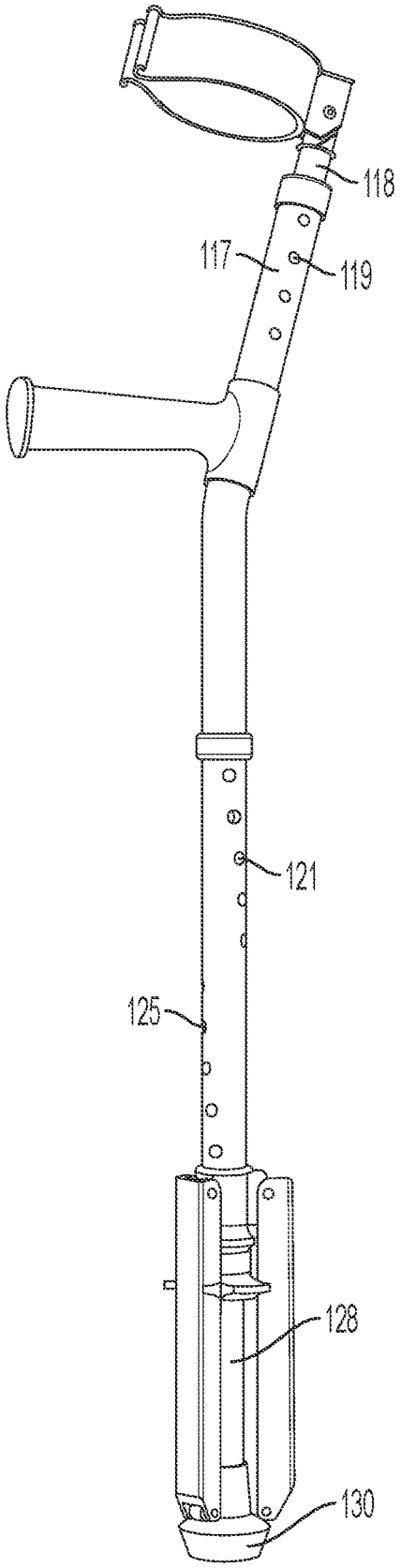
FIG. 4*a* illustrates an alternative embodiment of a multi-configuration crutch in a first configuration.
Figure 4B:
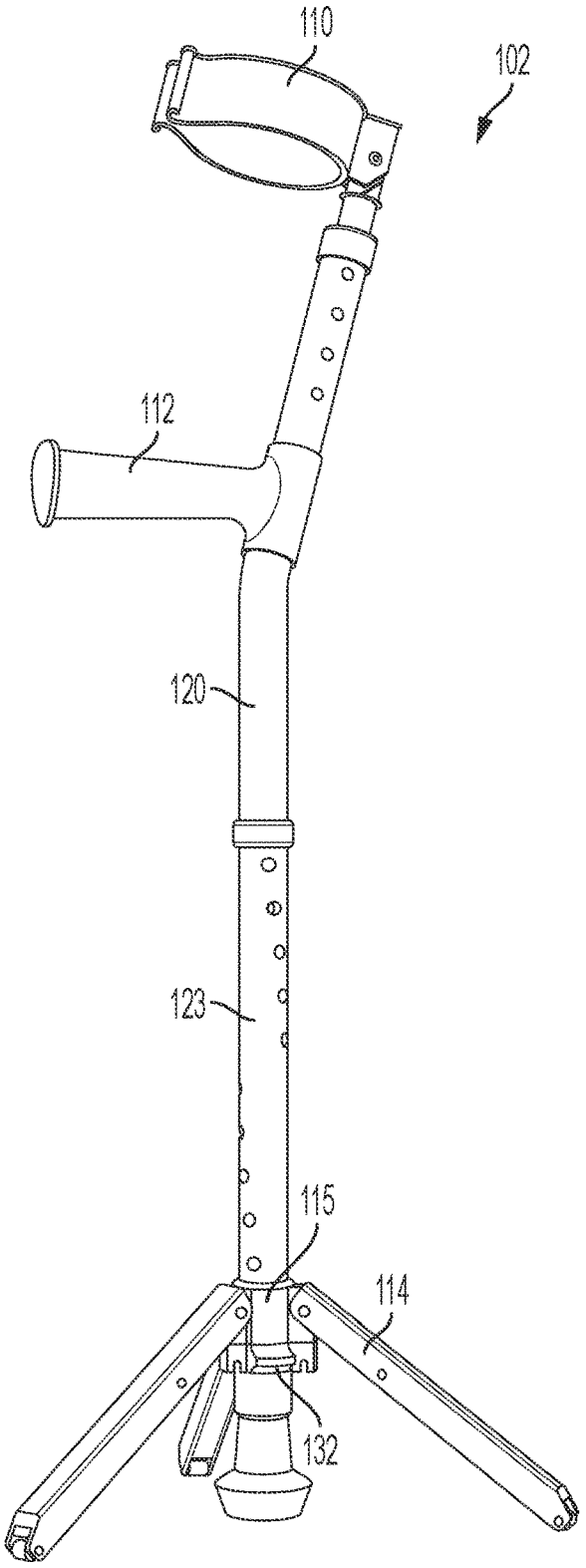
FIG. 4*b* illustrates the crutch of FIG. 4*a* in a second configuration.
Figure 4C:
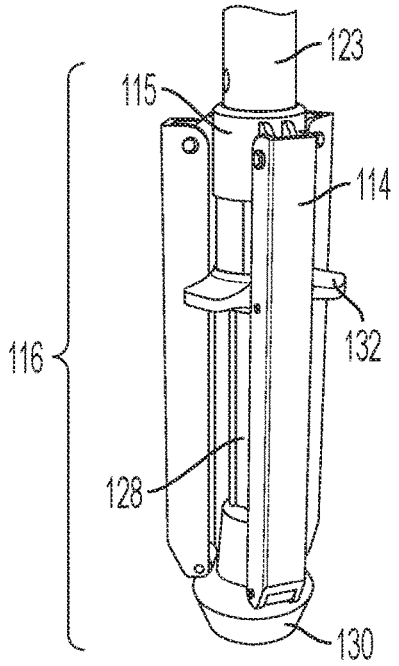
FIG. 4*c* is a close-up view of the lower portion of the crutch of FIG. 4*a;*
Figure 4D:
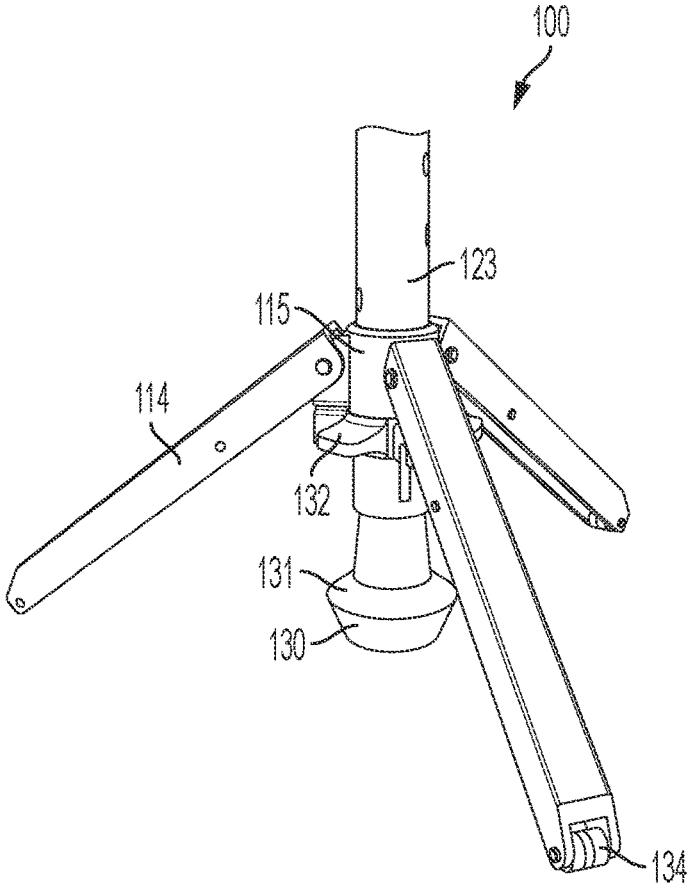
FIG. 4*d* is a close up view of the lower portion of the crutch of FIG. 4*b*.

In this embodiment, the base portion 116 comprises legs or base rods 114 that are hingedly attached to the hub portion 115 via hinge joints, as shown in FIGS. 4*c* and 4*d*. Three legs are shown, but it can be appreciated that additional legs may be used. The area between the legs 14 define the footprint of the crutch.

The base portion 116 further comprises a central leg 128. The end of the central leg 128 may be encapsulated with a rubber base 130 to increase friction between the crutch 102 and the ground. The central leg and rubber base 130 act to provide a stable single point of contact between the crutch 102 and the floor when used as a conventional crutch. It can be appreciated that the rubber base 130 has a slightly larger footprint than a conventional crutch. This allows for greater stability of the crutch during conventional use, but it is not too large as to prevent ease of use.

Also attached to the base portion 116 are pedals 132, or plinths. The pedals 132 may be rectangular in shape, and may extend from between the two adjacent legs 114 in a direction that is perpendicular with respect to the longitudinal axis of the main rod 120. The pedals act to release the legs from being secured against the hub portion 115 and act to release a locking mechanism provided between the legs and the hub portion 115.

The crutch 100 is shown in two different configurations in FIGS. 4*a* and 4*b*. FIG. 4*a* shows the crutch 100 in a first configuration intended for use as a conventional crutch. FIG. 4*b* shows the second configuration intended for use when the user is seated. In this configuration, the handle 112 is positioned (or can be positioned) at a height off the floor to allow the handle to be used to rest a foot on the handle.

In the first configuration, the longitudinal axis of the rods 114 is substantially in the same direction as the longitudinal axis of the main rod 120 and the central leg 128. The tips of the legs 114 are fitted with rollers 134, which assist in a smooth transition from the first configuration to the second configuration, and vice versa. In the first configuration, the rollers 134 are in contact with the rubber base 130 such that the rubber base provides the sole point of contact between the crutch 102 and the floor. This ensures a solid base for the crutch.

The rubber base 130 typically comprises a slanted edge 131 on which the rollers 134 rest in the first configuration. The rubber base 130 also has a flared base to improve stability, with the slanted edge 131 helping to ensure that the legs 114 sit flat against the base 130 without protruding and significantly increasing the overall footprint of the crutch 102. In addition, in the first configuration the central leg 128 is located substantially outside and below of the base rod 123. This is the configuration illustrated in FIG. 4*a*.

FIG. 4*b* shows the crutch 102 in the second configuration. The second configuration is achieved by the user pushing the rubber base 130 into the ground causing the rubber base to retract within the base rod 123. This action unlocks the legs 114 from against the raised lip 131, using the pedals 132 as described in more detail below, and this release allows them to splay outwards due to the rollers 134 acting against the ground. It can be appreciated that the rollers 134 may be angled relative to tips of the legs to disengage the rollers from the ground when the legs have splayed to a desired position.

In the second configuration, the central leg 128 is substantially inserted into the base rod 123 until the hub portion 115 makes contact with the rubber base 130. As noted, during this manoeuvre, the legs 114 are splayed outwards, and provide a large footprint and a stable base for the crutch 102. The rollers 134 make contact with the ground during this manoeuvre and assist in the smooth splaying of the legs 114. The slanted edge 131 helps guide the rollers 134, and thus the legs 114, into the splayed position during the maneuvering of the crutch 102 into the second configuration. The legs 114 are splayed at an angle that is no more than 90 degrees with respect to the longitudinal axis of the main rod 20. Typically the angle is between 30 and 60 degrees.

This reduces the height of the crutch 102 to a lower height suitable for a user to rest their leg against handle 112. Further height adjustments may be made by engaging press or spring buttons that engage with holes 121 on the base rod 123. In the embodiment shown, the holes spiral around the outer surface of the base rod 123 to prevent any weak sides of the rod 123.

This spiral arrangement may also allow the relative angle between the handle 112 and the legs 114 to be adjusted, which may be beneficial floor space only allows the legs to be placed in a particular position, which may not leave the handle facing the user to allow them to rest their foot upon the handle. Additional holes 125 are also shown. These holes may engage with the central leg 128 again using press or spring buttons that engage with holes 125. This can lock the central leg 128 into position in either the first or second configuration to further stabilise the crutch in the desired configuration.

As shown, the handle is substantially longer than typical crutch handles to provide a more stable surface against which an ankle or foot may rest. It can be appreciated that an intended use of this crutch is for users having foot casts or foot protective boots. Accordingly, the length of the handle may be approximately equal to or larger than a width of a plaster cast foot or a support boot for a broken leg or foot bone.

The pedals 132 may again be lifted used by the user to provide a downward force to the central leg 128 to manoeuvre the crutch 102 back into the first configuration, as shown in FIGS. 4*a* and 4*c*. Note that the rubber base 130 remains in contact with the ground in both the first and the second configuration.

Figure 5:
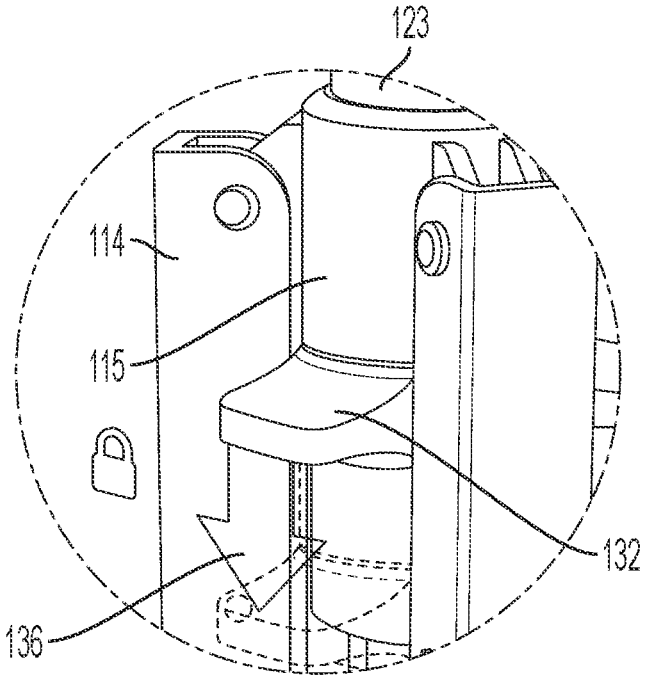
FIG. 5 is a close-up view of a pedal for changing the configuration of the clutch.

As shown in FIG. 5, the pedal 132 can be used to unlock the crutch from either the first or second configuration. The pedal 132 may raise a cam surface configured to interact with a rear surface of the legs to aid splaying and release of the legs. In such embodiments the legs may be locked into position against the hub portion 115 by a releasable locking means or may have a frictional engagement with the hub portion 115 or the pedal edges of a sufficient manner to hold the legs in place in the first configuration.

Alternatively or additionally a spring loaded lock may be used in a similar manner to a mechanical pen, where a series of cams and followers interact to rotate the central leg 128 relative to corresponding locking portions inside the central leg 128 or the base rod 123. Alternatively, the central leg 128 may be locked in position by manual rotation relative to the base rod 123 in a similar manner to that described in the first embodiment shown in FIGS. 1 to 3.

From reading the present disclosure, other variations and modifications will be apparent to the skilled person. Such variations and modifications may involve equivalent and other features which are already known in the art of receivers and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The applicant hereby gives notice that new claims may be formulated to such features and/or combinations of such features during the prosecution of the present application or of any further application derived therefrom. For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. A crutch for supporting a leg of a user, said crutch comprising:

a handle;

a base portion having a plurality of legs, said legs defining a footprint when contacting the ground wherein the base portion comprises a recess for each leg, each recess defining a movement path for one of the legs; and a main rod connecting the handle and the base portion, wherein the legs of the base portion are moveable to alter the height of the handle from a first configuration to a second configuration, and wherein in the first configuration the handle is positioned at a first height for gripping by an ambulatory user and in the second configuration the handle is positioned at a second, shorter, distance for resting a foot of a sitting user;

wherein the base portion comprises a hub portion and a locking section that cooperate to lock the legs parallel to a longitudinal axis of the main rod in the first configuration and wherein the locking section is rotatably engaged with the hub portion to releasably lock the legs in the first configuration; and wherein in the second configuration the legs of the base portion are splayed outward away from the longitudinal axis of the main rod to provide a larger footprint in the second configuration than in the first configuration.

2. The crutch according to claim 1, wherein the base portion is rotatable relative to the main rod to alter the length of the crutch from the first configuration to the second configuration.

3. The crutch according to claim 1, wherein the plurality of legs comprises at least three legs, an area between the legs defining the footprint of the base portion.

4. The crutch according to claim 3, wherein the legs are moveable to between 10 to 90 degrees away from the longitudinal axis of the main rod in the second configuration.

5. The crutch according to claim 1, wherein the legs are resiliently biased away from the longitudinal axis.

6. The crutch according to claim 1, wherein the hub portion and the locking section further cooperate to lock the splayed outward legs in the second configuration.

7. A crutch for supporting a leg of a user, said crutch comprising:

a handle;

a base portion having a plurality of legs, said legs defining a footprint when contacting the ground; and a main rod connecting the handle and the base portion;

wherein the legs of the base portion are moveable to alter the height of the handle from a first configuration to a second configuration, and wherein in the first configuration the handle is positioned at a first height for gripping by an ambulatory user and in the second configuration the handle is positioned at a second, shorter, height for resting a foot of a sitting user; and wherein in the second configuration the legs of the base portion are splayed to provide a larger footprint in the second configuration than in the first configuration;

wherein the base portion comprises a hub portion and a locking section that cooperate to lock the legs offset from and parallel to a longitudinal axis of the main rod in the first configuration; and wherein the hub portion comprises semi-circular openings, each semi-circular opening aligned with one of the plurality of legs in the second configuration to define an end stop for the leg to limit movement of the leg away from the main rod.

8. The crutch according to claim 7, wherein the locking section comprises a recess for each leg, each recess defining a movement path for one of the legs and wherein rotation of the locking section relative to the hub portion allows movement of the legs along the movement path.

* * * * *